US011112754B1

(12) United States Patent
Carter

(10) Patent No.: US 11,112,754 B1
(45) Date of Patent: Sep. 7, 2021

(54) GEAR ASSEMBLY FOR IMPROVED DOT ALIGNMENT IN AN IMAGING DEVICE

(71) Applicant: LEXMARK INTERNATIONAL, INC., Lexington, KY (US)

(72) Inventor: Daniel Lee Carter, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/912,204

(22) Filed: Jun. 25, 2020

(51) Int. Cl.
*G03G 21/18* (2006.01)

(52) U.S. Cl.
CPC ..... *G03G 21/1864* (2013.01); *G03G 21/185* (2013.01)

(58) Field of Classification Search
None
See application file for complete search history.

(56) References Cited

U.S. PATENT DOCUMENTS 6,704,529 B2 * 3/2004 Noh ..... G03G 15/0896 399/167
2012/0230731 A1 * 9/2012 Hashimoto ..... G03G 15/757 399/167

* cited by examiner

*Primary Examiner* — Victor Verbitsky

(57) ABSTRACT

A gear assembly for an imaging device includes a drive gear positioned to receive rotational force from the imaging device, and a driven gear positioned to mesh with and receive rotational force from the drive gear for rotating a photoconductive member. As the photoconductive member rotates, a rotational location on the drive gear that meshes with the driven gear when a latent image is formed on the photoconductive member is the same said rotational location on the drive gear that meshes with the driven gear when a toned image of the latent image is transferred from the photoconductive member to an image receiving medium.

17 Claims, 4 Drawing Sheets

GEAR ASSEMBLY FOR IMPROVED DOT ALIGNMENT IN AN IMAGING DEVICE

FIELD OF THE INVENTION

The present disclosure relates to dot alignment in an electrophotographic imaging device. It relates further to a gear assembly that allows correction of dot placement errors due to gear runout and eccentricity for improved dot alignment in the imaging device.

BACKGROUND

In a color electrophotographic imaging process, latent images composed of dots are formed on a plurality of photosensitive drums, which are in turn developed using a predetermined color of toner. The developed images are subsequently transferred from the photosensitive drum to a sheet of media, such as paper, in a one-step toner transfer process or, prior to the sheet of media, onto an intermediate transfer member (ITM) in a two-step toner transfer process, which travels past the photosensitive drums. The image in each color is created one line at a time, and the lines are oriented at right angles to the direction of travel of the sheet of media. The individually-generated images combine to form a full-color image. In a typical color laser printer, for example, the sheet of media passes through four color developing stations in series, with the colors being black, magenta, cyan and yellow.

Print quality is generally a function of accurate dot placement on print media. In some situations, certain tolerances or errors in various dimensions of gears driving rotatable components, such as the photosensitive drums, cause incorrect dot placement. For example, gear runout and/or eccentricity which causes a gear to not rotate exactly in line with its main axis may affect the rotational motion of a photosensitive drum and cause the placement of dots to deviate away from desired dot locations. As a result, individual images generated by each photosensitive drum may not be superimposed correctly when combined causing poor color alignment and poor print quality. Gear runout may be reduced or eliminated by using precision gears or by using special designs that use components other than gears, but these significantly increase the overall cost of the gear system. The inventors recognize a need to reduce and/or eliminate dot misalignments due gear runout at a lower cost.

SUMMARY

The foregoing and other are solved by using a gear assembly that passively corrects misalignments due to gear runout and/or eccentricity. In one embodiment, a gear assembly for an imaging device includes a drive gear positioned to receive rotational force from the imaging device, and a driven gear positioned to mesh with and receive rotational force from the drive gear for rotating a photoconductive member. As the drive gear rotates the driven gear to rotate the photoconductive member, a rotational location on the drive gear that meshes with the driven gear when a latent image is formed on the photoconductive member is the same rotational location on the drive gear that meshes with the driven gear when a toned image of the latent image is transferred from the photoconductive member to an image receiving medium. Having the same rotational location on the drive gear mesh with the driven gear during the formation of the latent image and the transfer of the toned image allows for the transfer of the toned image to counteract a mispositioning during the formation of the latent image such that a misalignment is reduced or eliminated.

In another embodiment, an imaging device includes a photoconductive drum rotatable from a first rotational position at which a latent image is formed on the photoconductive drum, to a second rotational position at which the latent image is developed into a toned image, and to a third rotational position at which the toned image is transferred from the photoconductive drum to an image receiving medium. The imaging device further includes a gear mechanism including a drive gear positioned to receive rotational force from the imaging device and a driven gear positioned to mesh with and receive rotational force from the drive gear for rotating the photoconductive drum. The drive gear is operative to rotate one revolution to cause the driven gear to rotate the photoconductive drum from the first rotational position to the third rotational position such that a rotational location on the drive gear that meshes with the driven gear when the latent image is formed on the photoconductive drum at the first rotational position is the same rotational location on the drive gear that meshes with the driven gear when the toned image is transferred from the photoconductive drum at the third rotational position.

In other embodiments, a pinion gear drivable by a motor provides the rotational force to the drive gear. The pinion gear rotates a number of complete revolutions while the drive gear rotates one revolution such that the formation of the latent image when the photoconductive drum is at the first rotational position and the transfer of the toned image when the photoconductive drum is at the third rotational position occurs at a same rotational location on the pinion gear. A developer roll is in contact with the photoconductive drum for developing the latent image into the toned image. A second driven gear is positioned to mesh with and receive rotational force from the drive gear for rotating the developer roll such that the drive gear drives both the photoconductive drum and developer roll to rotate.

DETAILED DESCRIPTION OF THE ILLUSTRATED EMBODIMENTS

Figure 1:
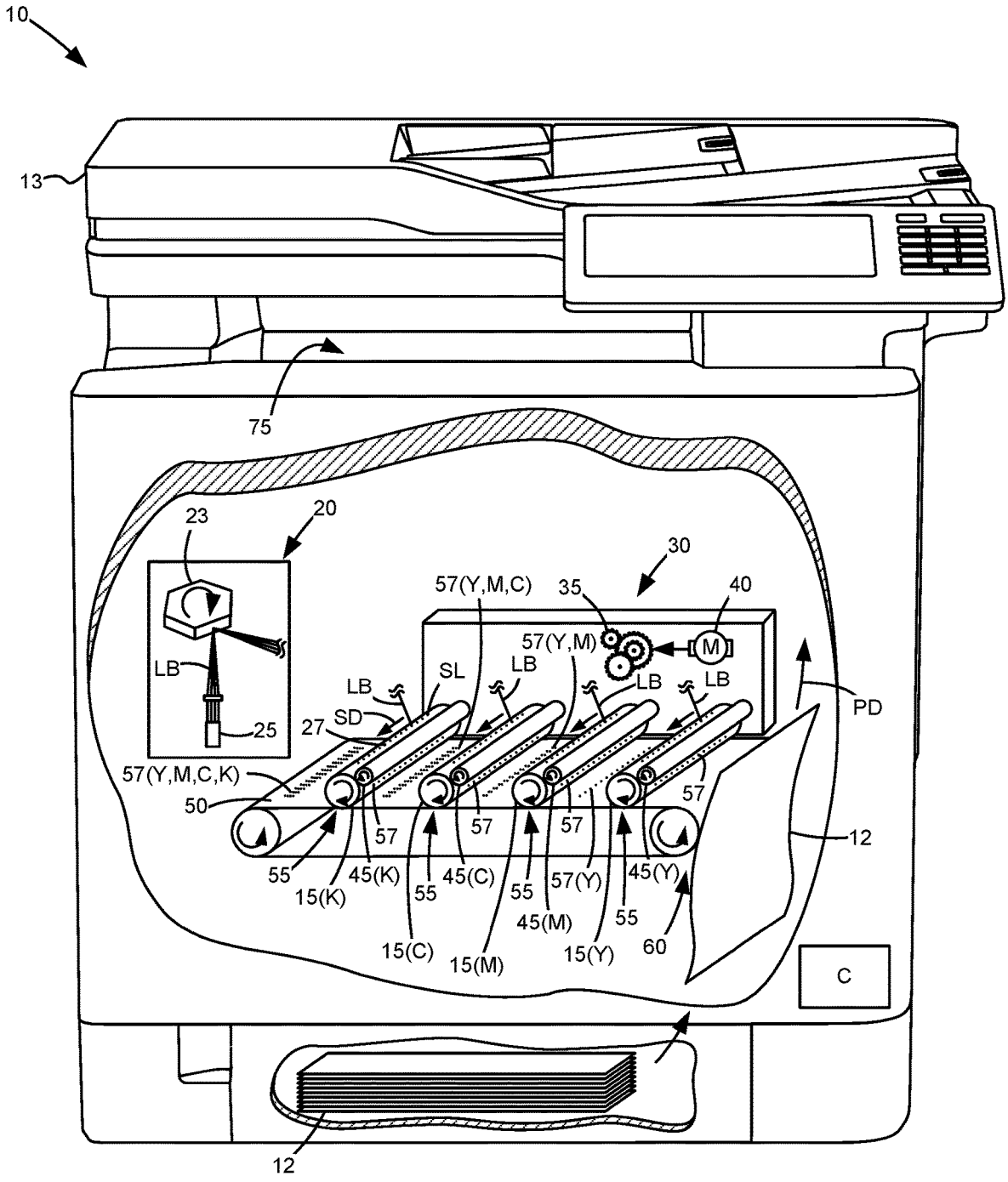
FIG. 1 is a diagrammatic view of an imaging device, including cutaway with a diagrammatic view of an imaging assembly, an image transfer assembly, and a gearbox assembly according to an example embodiment.

With reference to FIG. 1, a color electrophotographic imaging device 10 is shown according to an example embodiment. Imaging device 10 is used for printing images on media 12. Image data of the image to be printed on the media is supplied to imaging device 10 from a variety of sources such as a scanner 13, computer, laptop, mobile device, or like computing device. The sources directly or indirectly communicate with imaging device 10 via wired and/or wireless connection. A controller (C), such as an ASIC(s), circuit(s), microprocessor(s), etc., receives the image data and controls hardware of imaging device 10 to convert the image data to printed data on the sheets of media 12.

For color imaging device 10, a plurality of photoconductive (PC) drums 15 for each color plane yellow (Y), magenta (M), cyan (C), and black (K) are disposed along an intermediate transfer member (ITM) 50. During use, controller (C) controls a scanning unit 20 including a scan mirror 23 to scan laser beams LB from a light source 25 across a respective one of PC drums 15 to selectively discharge areas of the PC drum 15 in a scan direction SD. The discharged areas form a latent image including a plurality of latent image spots or dots 27 along a scan line SL corresponding to individual pixels of the image data. A gearbox assembly 30, which includes a gear mechanism 35, transfers rotational force from one or more motors 40 to PC drums 15 and respective developer rolls 45. The developer roll 45 applies toner particles to the latent image as the PC drum 15 rotates in order to create a toned image 57 on the PC drum 15. The toned images 57 from PC drums 15 are transferred to ITM 50 at respective first transfer nips 55 and combine to form partial color images 57(Y), 57(Y,M), 57(Y,M,C) as ITM 50 rotates until a full-color image 57(Y,M,C,K) is formed. The full color-image 57(Y,M,C,K) is then transported by the rotating ITM 50 to a second transfer nip 60 at which full-color image 57(Y,M,C,K) is transferred to a media sheet 12 travelling in a process direction PD. The media sheet 12 with the full-color image 57(Y,M,C,K) passes through a fuser (not shown) which applies heat and pressure to the media sheet 12 in order to fuse the toned image thereto. Ultimately, the media sheet 12 is either deposited into an output media area 75 or enters a duplex media path for transport to the second transfer nip 60 for imaging on the other side of the media sheet 12.

Precise and accurate placement of latent image dots on the PC drum and toned image dots on the ITM are necessary to ensure high print quality. That is, if latent image dots and toned image dots are positioned at desired pixel/dot locations, the printed image corresponds nearly exactly with the image data. If not, the printed image can have poor quality, especially in the form of misalignments. Different alignment and calibration techniques are typically used to achieve accurate registration of latent image dots on the PC drum so that toned image dots from each PC drum are transferred and superimposed correctly when combined at the ITM which directly affects print quality. If the latent image dots are mispositioned relative to their desired dot locations at the PC drum, they tend to also misposition toned image dots at the ITM upon transfer. Even for a precisely aligned and calibrated scanning system, it is still possible for image dots to drift out of alignment due to gear runout and/or eccentricity. For example, gear runout and eccentricity may cause an interference between gears at certain angular positions of rotation causing the gears to momentarily bind before the gears move past the interfering position. In imaging device 10, for example, this momentary binding between gears driving the PC drum may cause the PC drum to momentarily stop and result in the placement of latent image dots on the PC drum and/or the placement of toned image dots on the ITM to deviate from desired dot locations.

Figure 2:
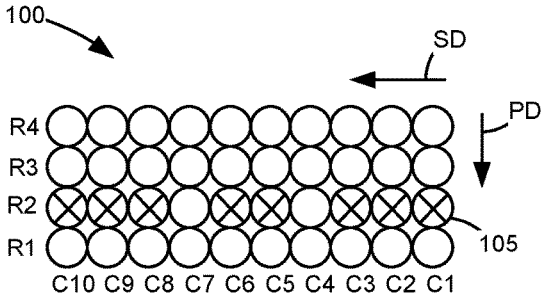
FIG. 2 is a diagrammatic view of a representative bitmap of image data to be printed according to an example embodiment.

FIG. 2 graphically illustrates an example bitmap 100 of image data to be printed for one of the YMCK color image planes. Bitmap 100 includes a plurality of rows R1-R4 and columns C1-C10 of pixel locations. Each circle depicts potential pixel locations with each column representing a printable portion of the image plane that extends in process direction PD and each row representing a printable portion of the image plane in scan direction SD. Locations of pixels which are to be printed are depicted by circles marked with "X", hereinafter referred to as target pixel locations 105, along row R2 and columns C1-C3, C5-C6, C8-C10 of bitmap 100. The target pixel locations 105 correspond to target locations for latent image dots on the PC drum during latent image formation and target locations for toned image dots on the ITM during toner image transfer.

Figure 3:
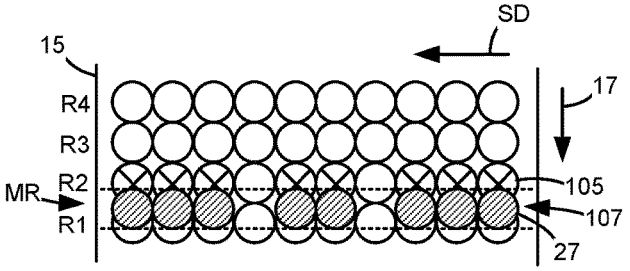
FIG. 3 is a diagrammatic view illustrating mispositioning of latent image dots on a photoconductive drum relative to target dot locations due to runout.

As before, latent image dots are ideally formed on the PC drum at the target pixel locations 105 and toned image dots are ideally transferred from the PC drum to the ITM also at the target pixel locations 105 to achieve high print quality. If, for example, there is runout and/or eccentricity at a location on the drive gear driving the PC drum to rotate during a time a latent image is formed along a scan line on the PC drum, the gears may bind and cause the PC drum to momentarily stop such that latent image dots become mispositioned relative to the target pixel locations 105. FIG. 3 illustrates this where light-shaded circles representing latent image dots 27 on PC drum 15 deviate from corresponding target pixel locations 105. As shown, a scan path 107 for the laser beam extends along scan direction SD. If the gears bind and PC drum 15 momentarily stops, the laser beam is scanned without the target pixel locations 105 on PC drum 15 being positioned within scan path 107 resulting in the formation of latent image dots 27 along a misaligned row MR leading the target pixel locations 105 in a direction of rotation 17 of PC drum 15 corresponding to the process direction. The amount of deviation of misaligned row MR from the target pixel locations 105 depends on the amount of lost motion of the PC drum 15 caused by gear runout.

Figure 4A:
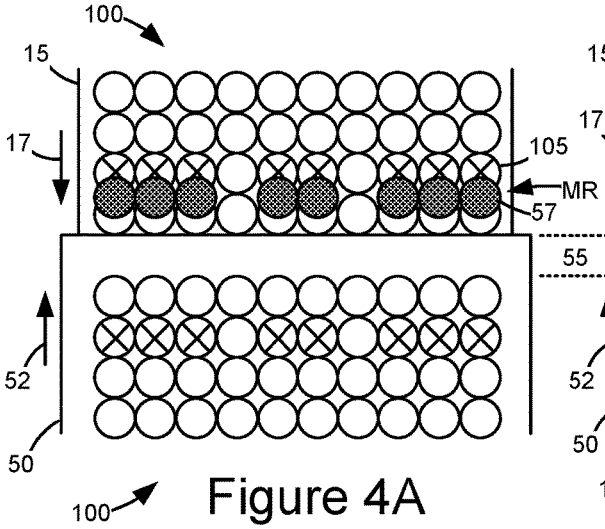
FIGS. 4A-4D are diagrammatic views illustrating transfer of toned image dots that deviate from target dot locations of the image data due to runout.
Figure 4B:
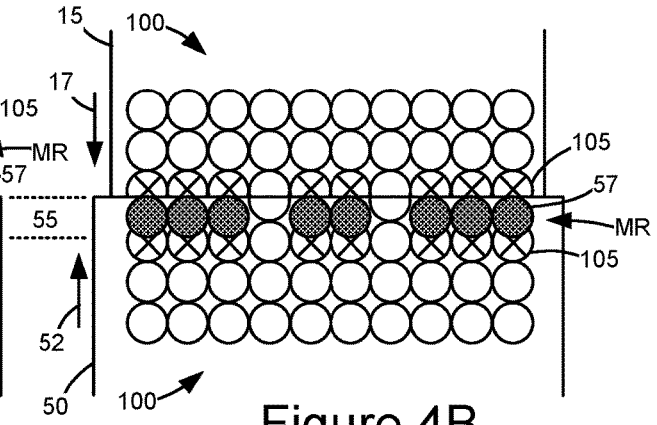
Figure 4C:
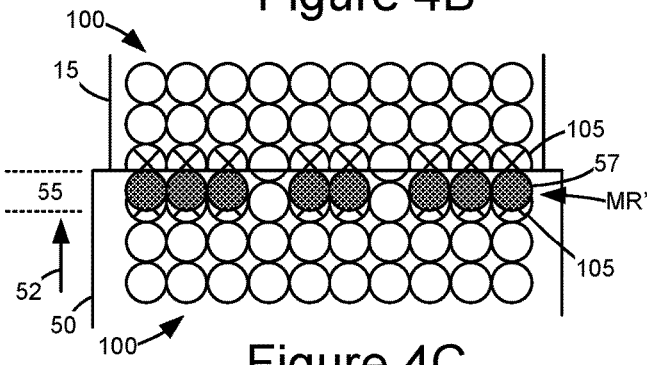
Figure 4D:
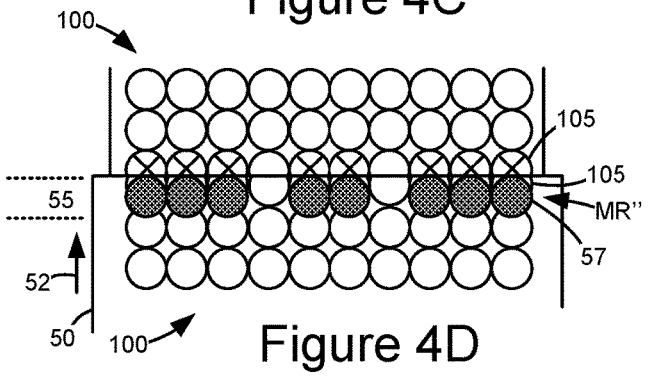

As PC drum 15 rotates, latent image dots 27 are developed by developer roll 45 into toned image dots which are transported by PC drum 15 to the first transfer nip for transfer to the ITM. FIG. 4A graphically illustrates PC drum 15 rotating in direction 17, ITM 50 moving in direction 52 corresponding to the process direction, and a toner image transfer region 55 on ITM 50 (coinciding with the first transfer nip) where toned image dots 57 (shown as dark-shaded circles) are transferred from PC drum 15 to ITM 50. Bitmap 100 is also shown on each of PC drum 15 and ITM 50 to illustrate dot/pixel correct positions. If, for example, there is no runout and/or eccentricity at a mesh location on the drive gear during transfer of the toned image dots 57 from PC drum 15 to ITM 50, PC drum 15 continues to rotate in direction 17 while ITM 50 advances in direction 52 such that toned image dots 57 along misaligned row MR on PC drum 15 are positioned within image transfer region 55 in time when corresponding pixel locations on ITM 50 arrive at image transfer region 55 resulting in toned image dots 57 being transferred along corresponding misaligned row MR on ITM 50 as shown in FIG. 4B. On the other hand, if there is runout and/or eccentricity on the drive gear during image transfer, the gears may again bind and cause PC drum 15 to momentarily stop while ITM 50 continues to advance in direction 52. Depending on the amount of PC drum lost motion caused by gear runout, toned image dots 57 may be transferred to ITM 50 along a misaligned row MR' leading the target pixel locations 105 in direction 52 as shown in FIG. 4C, or along a misaligned row MR" lagging behind the target pixel locations 105 in direction 52 as shown in FIG. 4D. In each of FIGS. 4B-4D, toned image dots 57 are transferred to ITM 50 at locations that deviate from the target pixel locations 105 thereby reducing print accuracy when toned image dots 57 are combined to form the full-color image.

Figure 5A:
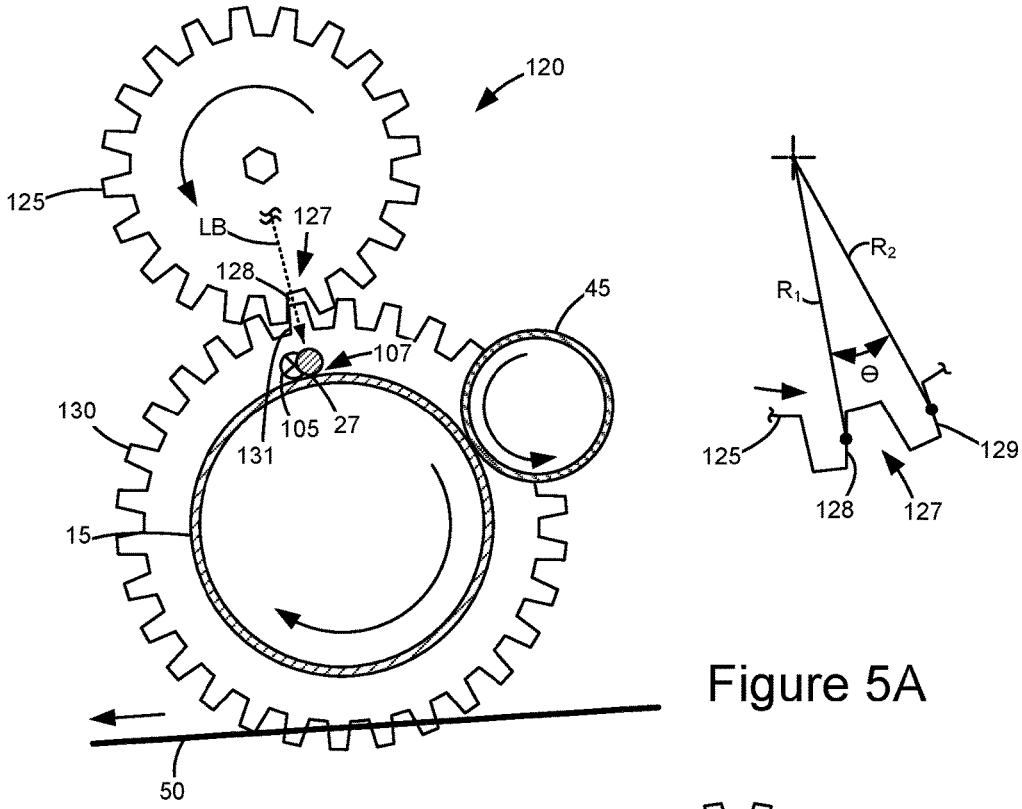
FIGS. 5A-5C are diagrammatic views illustrating a gear arrangement that reduces misalignments due to gear runout, according to an example embodiment.
Figure 5B:
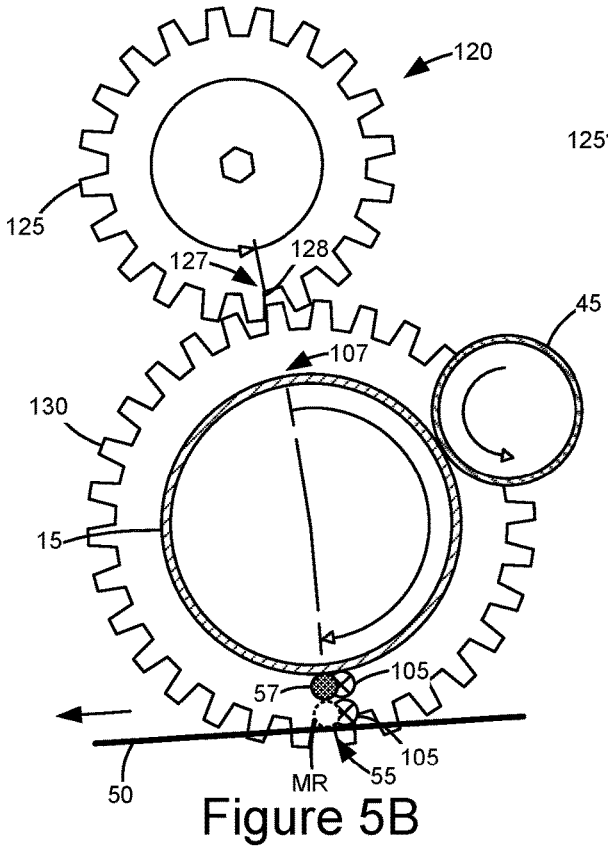
Figure 5C:
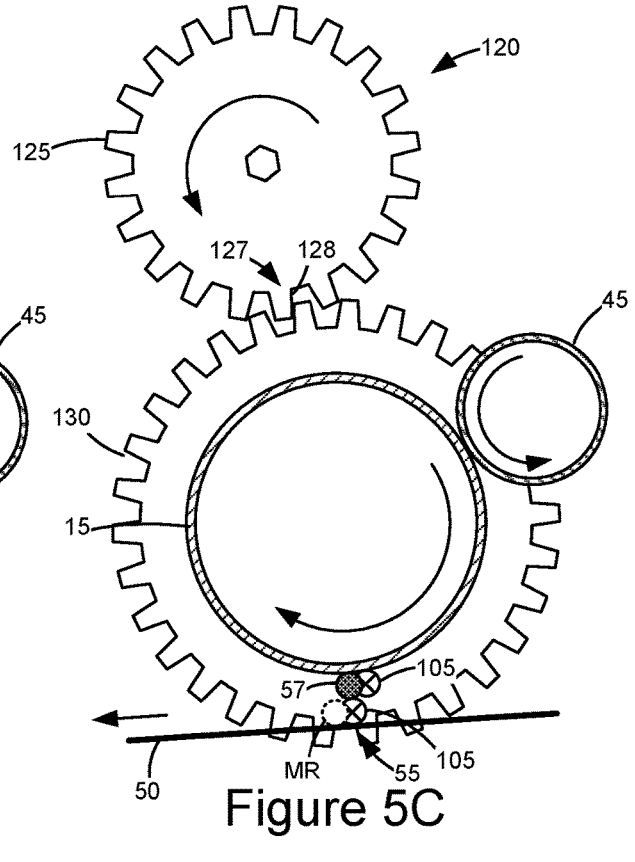

In order to reduce, if not eliminate, misalignments due to runout and/or eccentricity, the gear box assembly includes a gear configuration for driving the PC drum which allows for a mispositioning of a latent image dot on the PC drum during latent image formation to be counteracted during transfer of its corresponding toned image dot to the ITM such that the toned image dot still lands at or relatively close to a target dot location on the ITM even after the mispositioning of the latent image dot at the PC drum. An example gear arrangement 120 including a drive gear 125 and a driven gear 130 is shown in FIGS. 5A-5C to illustrate this functionality. It is noted that drive gear 125 and driven gear 130 are diagrammatically shown in FIGS. 5A-5C for purposes of illustration and that gear dimensions and profile shown may not necessarily reflect actual gear specifications.

Drive gear 125 provides rotational force to driven gear 130 in order to rotate PC drum 15 (i.e., PC drum 15 rotates together with driven gear 130). In FIG. 5A, laser beam LB forms latent image dot 27 at a location along scan path 107 on PC drum 15 when a rotational location 127 on drive gear 125 meshes with driven gear 130. In the example shown, rotational location 127 is depicted by a drive tooth flank 128 of drive gear 125 that contacts a driven tooth flank 131 of driven gear 130 as drive gear 125 rotates counter-clockwise as viewed in FIG. 5A. Latent image dot 27 deviates from target dot location 105 by a distance corresponding to a time duration PC drum 15 momentarily stops caused by the gear runout error at rotational location 127. In one example, gear runout may be expressed in terms of a difference between radial distances of corresponding contact points of consecutive drive gear teeth flanks (e.g., $|R_1-R_2|$ for consecutive drive teeth flanks 128, 129). In another example, gear runout may relate to an angular position error expressed in terms of a difference between actual angular distance θ between the corresponding contact points of consecutive drive teeth flanks 128, 129 and a calculated angular distance between consecutive gear teeth based on the design of drive gear 125 (e.g., angular position error=$|\theta-\theta_{(cal)}|$, where $\theta_{(cal)}$=360°/T and T=number of teeth of the drive gear).

To counteract this deviation, drive gear 125 is configured such that PC drum 15 experiences relatively close or the same amount of lost motion (e.g., substantially the same gear runout or angular position error) during transfer of the toned image dot to ITM 50 to cancel out or offset the deviation. This is achieved by allowing the same rotational location 127 on drive gear 125 to mesh with driven gear 130 during transfer of the toned image dot 57 to ITM 50 as shown in FIG. 5B. More specifically, drive gear 125 rotates one revolution (i.e., 360°) from the time latent image dot 27 is formed along scan path 107 on PC drum 15 to the time its corresponding toned image dot 57 is transferred to ITM 50 such that the drive tooth flank 128 of drive gear 125 that contacts driven gear 130 when latent image dot 27 is formed on PC drum 15 is the same drive tooth flank 128 of drive gear 125 that contacts driven gear 130 when the toned image dot 57 arrives at the image transfer region 55 on ITM 50. The dashed open circle on ITM 50 shown in FIG. 5B represents the misaligned row MR along which toned image dot 57 is supposed to be transferred on ITM 50 when there is substantially no runout during image transfer. However, the gear runout error at rotational location 127 of drive gear 125 causes PC drum 15 to momentarily stop for a time duration while ITM 50 continues to advance, as shown in FIG. 5C, such that toned image dot 57 aligns with the target dot location 105 on ITM 50 at the image transfer region 55 instead of with the misaligned row MR once drive gear 125 moves past the interfering position. Accordingly, the transfer of toned image dot 57 from PC drum 15 to ITM 50 counteracts the mispositioning of latent image dot 27 at the outset during latent image formation. The same applies for each rotational location on drive gear 125 such that any misalignment due to gear runout and/or or angular position error at a rotational location on drive gear 125 is reduced and/or eliminated when toned image dots are transferred to ITM 50.

Figure 6:
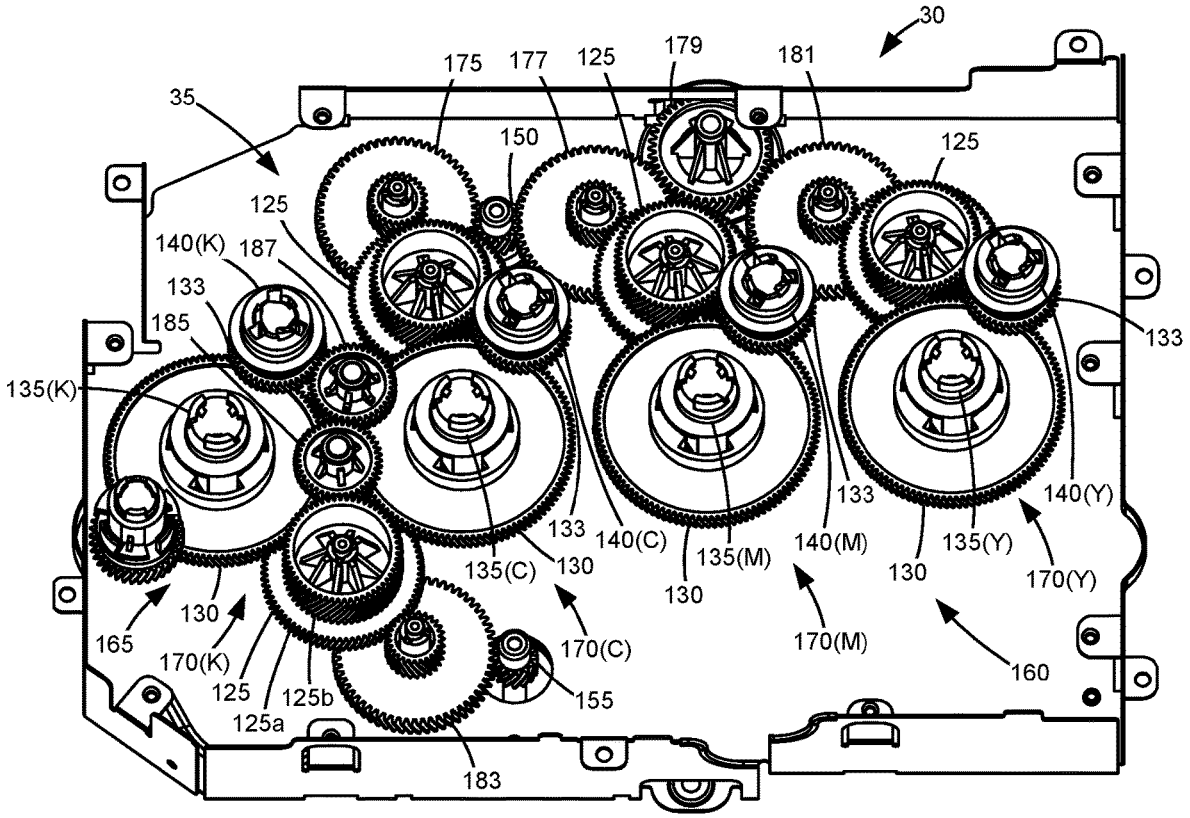
FIG. 6 is a perspective view of the gearbox assembly according to an example embodiment.
Figure 7:
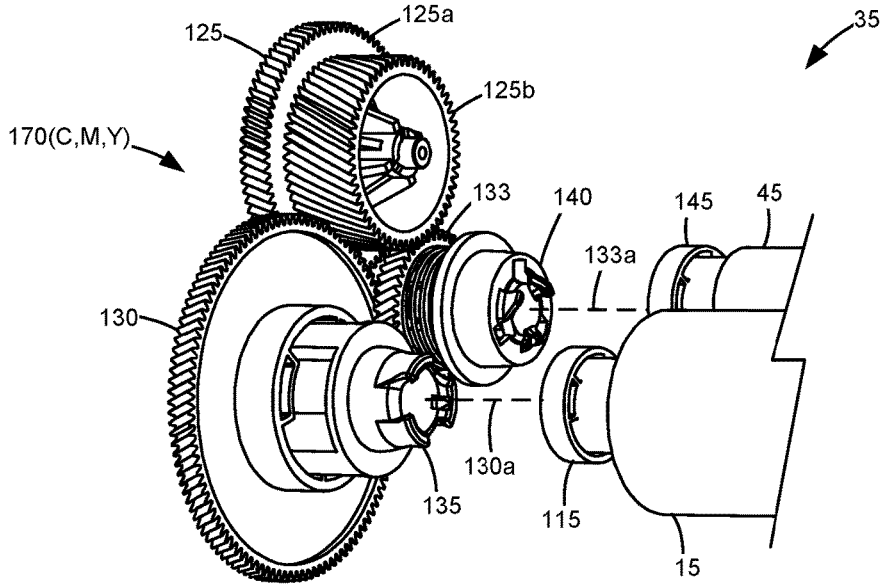
FIG. 7 is a perspective view of a gear subassembly of the gearbox assembly including a compound drive gear that drives both a photoconductive drum and developer roll to rotate, according to an example embodiment.

With reference to FIGS. 6-7, an example implementation of gearbox assembly 30 and its gear mechanism 35 will be described. Gearbox assembly 30 includes a pair of drive couplers 135, 140 (for each of the YMCK color image planes) that mate with corresponding drive couplers 115, 145 of PC drum 15 and developer roll 45, respectively. A first pinion gear 150 driven by a motor (not shown) provides rotational force to each pair of yellow, magenta, cyan (YMC) drive couplers 115, 145 via a first gear train 160. A second pinion gear 155 driven by a motor (not shown) provides rotational force to the pair of black (K) drive couplers 115, 145 via a second gear train 165. In this example, first and second pinion gears 150, 155 are substantially the same. First and second gear trains 160, 165 include gear subassemblies 170(Y), 170(M), 170(C), 170(K), each including a compound drive gear 125, a driven PC drum gear 130, and a driven developer gear 133. Gear subassemblies 170(Y,C,M) of first gear train 160 receive rotational power from first pinion gear 150 via one or more gears. In the example shown, compound drive gear 125 of gear subassembly 170(C) is connected to first pinion gear 150 via a first compound gear 175, compound drive gear 125 of gear subassembly 170(M) is connected to first pinion gear 150 via a second compound gear 177, and compound drive gear 125 of gear subassembly 170(Y) is connected to first pinion gear 150 via second compound gear 177, an idler gear 179, and a third compound gear 181. Gear subassembly 170(K) of second gear train 165 receives rotational power from second pinion gear 155 via a fourth compound gear 183. In this example, first, second, third, and fourth compound gears 175, 177, 181, and 183 are substantially the same.

Each compound drive gear 125 has a larger diameter gear 125*a* that meshes with a corresponding one of compound gear 175, 177, 181, 183 and a smaller diameter gear 125*b* that meshes with both PC drum gear 130 and developer gear 133. Drive couplers 135, 140 are respectively attached to PC drum gear 130 and developer gear 133 such that when drive couplers 135, 140 are operatively coupled to drive couplers 115, 145 of PC drum 15 and developer roll 45, respectively, PC drum 15 and developer roll 45 rotates together with PC drum gear 130 and developer gear 133, respectively. In the example illustrated, drive coupler 115 is operatively connected directly to PC drum 15 such that PC drum 15 rotates about an axis of rotation 130*a* of PC drum gear 130 and drive coupler 145 is operatively connected directly to developer roll 45 such that developer roll 45 rotates about an axis of rotation 133*a* of developer gear 133. However, drive couplers 115, 145 may be operatively connected indirectly (through one or more intermediate gears) to PC drum 15 and developer roll 45, respectively, in other embodiments. It is also noted that although the gear arrangement between compound drive gear 125, PC drum gear 130 and developer gear 133 in gear subassembly 170(K) differs from the gear arrangement in gear subassemblies 170(Y,M,C) (e.g., in gear subassembly 170(K), smaller diameter gear 125*b* of compound drive gear 125 meshes with PC drum gear 130 from below and indirectly meshes with developer gear 133 via idler gears 185, 187), gear subassembly 170(K) operates in a similar manner as gear subassemblies 170(C,Y,M) with respect to driving the PC drum and developer roll to rotate. Having the same compound drive gear 125 rotate both PC drum gear 130 and developer gear 133 instead of using two separate gears allows for reduction in the number of components and cost of the gearbox assembly. In one example, a rotational speed ratio between PC drum surface and developer surface is about 1:1.45 such that developer roll 45 rotates at a faster speed than PC drum 15 to provide sufficient scrub for developing latent images to toned images.

In an example embodiment, PC drum gear 130 and developer gear 133 are made with a given number of teeth to align with the distance of PC drum rotation from latent image formation to toner image transfer equal to one revolution of compound drive gear 125 driving PC drum gear 130 and developer gear 133 to rotate. This allows the formation of a latent image dot and transfer of its corresponding toned image dot to occur at the same location on compound drive gear 125 in order to cancel out runout and eccentricity errors, as discussed above. As an example, a PC drum gear 130 having 109 teeth and a smaller diameter gear 125*b* of compound drive gear 125 having 56 teeth may be provided such that one revolution of compound drive gear 125 causes PC drum 15 to rotate about 184.954°(≈56*360°/109) from latent image formation to toner image transfer, both occurring at the same location on compound drive gear 125. Further, in this example, every gear tooth of gear 125*b* is in contact with PC drum gear 130 for about 6.4°360°/56) rotation of gear 125*b*, thereby defining an effective area within 6.4° of rotational position (i.e., from 0° to about 6.4° of rotation) of a gear tooth of compound drive gear 125 where runout and/or angular position error may occur and thereafter corrected as the same gear tooth contacts PC drum gear 130 during latent image formation and toner image transfer of a dot. Assuming, for example, runout exists during the entire duration of 6.4° rotation of a gear tooth of compound drive gear 125 which corresponds to about 3.3° (≈6.4°*56/109) rotation of PC drum gear 130, a corresponding 3.3° PC drum error that occurs during latent image formation is substantially canceled out by a subsequent 3.3° PC drum error that occurs during toner image transfer as the same gear tooth of compound drive gear 125 is in contact with PC drum gear 130 during both times of latent image formation and toner image transfer. Depending on the design and architecture of imaging device components, other gear dimensions and/or profiles may be used to achieve the same functionality.

In a further embodiment, the gear ratio from each compound gear 175, 177, 181, 183 to a corresponding compound drive gear 125 is 3:1 such that each compound gear 175, 177, 181, 183 turns three revolutions as compound drive gear 125 rotates one revolution from latent image formation to toner image transfer. In addition, the gear ratio from each pinion gear 150, 155 to corresponding compound gear 175, 177, 181, 183 is 4:1 such that each pinion gear 150, 155 turns twelve revolutions as compound drive gear 125 rotates one revolution from latent image formation to toner image transfer. Idler gear 179 meshed between compound gear 177 and compound gear 181 turns four revolutions as compound drive gear 125 rotates one revolution. Having pinion gear 150, 155 rotate a number of exact complete revolutions for every one complete revolution of compound drive gear 125 allows for the formation of a latent image dot and transfer of its corresponding toned image dot to occur at the same location on the pinion gear in order to substantially cancel out motor runout in a similar manner as described above with respect to compound drive gear 125. As before, depending on the design and architecture of imaging device components, other gear ratios may be used to achieve the same functionality.

Further, the configuration allows for runout and/or angular position errors of gears 175, 177, 179, 181, 183, 150, and 155 to be canceled out as latent image dots are formed and corresponding toned image dots are transferred at the same location (e.g., the same gear tooth flank) on the gears due to integer gear ratios. As an example, for a compound gear 175 having 26 gear teeth, if runout exists during an entire duration of 13.8°(≈360°/26) rotation of a gear tooth which corresponds to about 2.4°(≈13.8°*(1/3)*(56/109)) rotation of PC drum gear 130, a corresponding 2.4° PC drum error that occurs during latent image formation is substantially canceled out by a subsequent 2.4° PC drum error that occurs during toner image transfer as the same gear tooth drives the PC drum during both times of latent image formation and toner image transfer. As another example, for a pinion gear 150 having 15 gear teeth, if runout exists during an entire duration of 24°(≈360°/15) rotation of a pinion gear tooth which corresponds to about 1°(≈24°*(1/12)*(56/109)) rotation of PC drum gear 130, a corresponding 1° PC drum error that occurs during latent image formation is substantially canceled out by a subsequent 1° PC drum error that occurs during toner image transfer as the same pinion gear tooth drives the PC drum during both times of latent image formation and toner image transfer.

The foregoing illustrates various aspects of the invention. It is not intended to be exhaustive. Rather, it is chosen to provide the best mode of the principles of operation and practical application known to the inventors so one skilled in the art can practice it without undue experimentation. All modifications and variations are contemplated within the scope of the invention as determined by the appended claims. Relatively apparent modifications include combining one or more features of one embodiment with those of another embodiment.

The invention claimed is:

1. A gear assembly for an imaging device, comprising:

a drive gear positioned to receive rotational force from the imaging device, the drive gear having a set of gear teeth;

a driven gear positioned to mesh with the set of gear teeth of the drive gear and receive rotational force from the drive gear for rotating a photoconductive member, wherein as the drive gear rotates the driven gear to rotate the photoconductive member, a rotational location on the drive gear that meshes with the driven gear when a latent image is formed on the photoconductive member is the same said rotational location on the drive gear that meshes with the driven gear when a toned image of the latent image is transferred from the photoconductive member to an image receiving medium; and a second driven gear positioned to mesh with the set of gear teeth of the drive gear and receive rotational force from the drive gear for rotating a developer roll such that the drive gear drives both the photoconductive member and the developer roll to rotate.

2. The gear assembly of claim 1, wherein the drive gear rotates one revolution from a time when the latent image is formed on the photoconductive member to a time when the toned image is transferred from the photoconductive member to the image receiving medium.

3. The gear assembly of claim 2, further comprising a pinion gear drivable by a motor to provide the rotational force to the drive gear, wherein the pinion gear rotates a number of complete revolutions as the drive gear rotates one revolution such that the formation of the latent image and the transfer of the toned image occurs at a same rotational location on the pinion gear.

4. The gear assembly of claim 1, wherein the driven gear rotates less than 360° from a time when the latent image is formed on the photoconductive member to a time when the toned image is transferred from the photoconductive member to the image receiving medium.

5. The gear assembly of claim 1, wherein the rotational location on the drive gear is defined by a gear tooth flank that contacts the driven gear as the drive gear rotates.

6. The gear assembly of claim 1, wherein the drive gear includes a compound gear having a gear with the set of gear teeth that meshes with both the driven gear and the second driven gear.

7. A gear assembly for an imaging device, comprising:

a drive gear positioned to receive rotational force from the imaging device, the drive gear having a set of gear teeth;

a driven gear positioned to mesh with the set of gear teeth of the drive gear and receive rotational force from the drive gear for rotating a photoconductive member, wherein the drive gear is operative to rotate one revolution from a time when a latent image is formed on the photoconductive member to a time when a toned image of the latent image is transferred from the photoconductive member to an image receiving medium such that the formation of the latent image and the transfer of the toned image occurs at a same rotational location on the drive gear that meshes with the driven gear when the latent image is formed and the toned image is transferred; and a second driven gear positioned to mesh with the set of gear teeth of the drive gear and receive rotational force from the drive gear for rotating a developer roll such that the drive gear drives both the photoconductive member and the developer roll to rotate.

8. The gear assembly of claim 7, wherein the driven gear rotates less than 360° from the formation of the latent image to the transfer of the toned image.

9. The gear assembly of claim 7, wherein the drive gear includes a compound drive gear having a gear with the set of gear teeth that meshes with both the driven gear and the second driven gear.

10. The gear assembly of claim 7, further comprising a pinion gear driven by a motor to provide the rotational force to the drive gear, wherein the pinion gear rotates a number of complete revolutions as the drive gear rotates one revolution such that the formation of the latent image and the transfer of the toned image occurs at a same rotational location on the pinion gear.

11. The gear assembly of claim 10, further comprising a gear train connected between the pinion gear and the drive gear, wherein gears of the gear train have integer gear ratios relative to each other.

12. An imaging device, comprising:

a photoconductive drum rotatable from a first rotational position at which a latent image is formed on the photoconductive drum, to a second rotational position at which the latent image is developed into a toned image, and to a third rotational position at which the toned image is transferred from the photoconductive drum to an image receiving medium;

a developer roll in contact with the photoconductive drum for developing the latent image into the toned image; and a gear mechanism including a drive gear having a set of gear teeth and positioned to receive rotational force from the imaging device and a driven gear positioned to mesh with a set of gear teeth of the drive gear and receive rotational force from the drive gear for rotating the photoconductive drum, wherein the drive gear is operative to rotate one revolution to cause the driven gear to rotate the photoconductive drum from the first rotational position to the third rotational position such that a rotational location on the drive gear that meshes with the driven gear when the latent image is formed on the photoconductive drum at the first rotational position is the same said rotational location on the drive gear that meshes with the driven gear when the toned image is transferred from the photoconductive drum at the third rotational position, and wherein the gear mechanism further includes a second driven gear positioned to mesh with the set of gear teeth of the drive gear and receive rotational force from the drive gear for rotating the developer roll such that the drive gear drives both the photoconductive drum and the developer roll to rotate.

13. The imaging device of claim 12, wherein the photoconductive drum rotates less than 360° from the first rotational position to the third rotational position.

14. The imaging device of claim 12, wherein the photoconductive drum rotates about an axis of rotation of the driven gear.

15. The imaging device of claim 12, further comprising a pinion gear drivable by a motor to provide the rotational force to the drive gear, wherein the pinion gear rotates a number of complete revolutions while the drive gear rotates one revolution such that the formation of the latent image when the photoconductive drum is at the first rotational position and the transfer of the toned image when the photoconductive drum is at the third rotational position occurs at a same rotational location on the pinion gear.

16. The imaging device of claim 12, wherein the drive gear includes a compound drive gear.

17. The imaging device of claim 12, wherein the developer roll rotates about an axis of rotation of the second driven gear.

* * * * *